United States Patent [19]

Seki

[11] 4,436,238

[45] Mar. 13, 1984

[54] APPARATUS FOR ATTACHING FASTENER ELEMENTS ONTO A GARMENT

[75] Inventor: Fumio Seki, Toyama, Japan

[73] Assignee: Yoshida Kogyo K K, Tokyo, Japan

[21] Appl. No.: 212,610

[22] Filed: Dec. 3, 1980

[30] Foreign Application Priority Data

Dec. 13, 1979 [JP] Japan ..... 54-172896[U]

[51] Int. Cl.[3] ..... A41H 37/04; A41H 37/16

[52] U.S. Cl. ..... 227/149; 227/15; 227/152

[58] Field of Search ..... 227/15, 16, 17, 149, 227/156, 48, 152

[56] References Cited

U.S. PATENT DOCUMENTS

| | | | |
|---|---|---|---|
| 1,373,461 | 4/1921 | Stuart | 227/15 |
| 1,901,386 | 3/1933 | White | 227/149 X |
| 2,310,008 | 2/1943 | Wolff et al. | 227/48 |
| 2,612,281 | 9/1952 | Erhardt, Jr. | 227/149 X |
| 2,992,431 | 7/1961 | Jensen | 227/15 X |

*Primary Examiner*—Paul A. Bell

*Attorney, Agent, or Firm*—Bucknam and Archer

[57] ABSTRACT

An apparatus for attaching a pair of fastener elements onto a garment comprising a plunger reciprocably mounted in a bored head for movement along a path toward and away from a stationary die mounted on a table in opposite relation to the bored head, the plunger having a punch for coacting with the die to attach the pair of fastener elements onto the garment from opposite sides thereof, and first and second means mounted respectively on the bored head and on the die for releasably holding the fastener elements in the path in front of the punch and the die. The first means is actuatable by the punch for releasing the one element. The second means is responsive to coaction with the first means for releasing the other element.

1 Claim, 6 Drawing Figures

APPARATUS FOR ATTACHING FASTENER ELEMENTS ONTO A GARMENT

BACKGROUND OF THE INVENTION

1. Field of the Invention

The present invention relates to an apparatus for attaching pairs of fastener elements such as snap fasteners, buttons, ornaments or the like onto a garment.

2. Prior Art

Fasteners concerned are composed of a pair of mating fastener elements between which is sandwiched a garment by clinching engagement therebetween. Setting of these elements properly on the garment needs to keep the mating element pair placed in an accurate alignment with each other with their respective postures unchanged until they contact with the garment.

There have been proposed a number of the fastener attaching machines. A common problem associated with those conventional apparatus is however that such fastener elements relatively small in size and light in weight tend to be displaced or detached from a suitable position before attachment to the garment under the influence of an external force that may be exerted from the garment or foreign matters.

Japanese Patent Publication No. 49-29698, published Aug. 6, 1974 discloses an apparatus designed to reduce such problems by providing a reciprocating punch and a die vertically arranged in opposite relation with each other for attaching a pair of fastener elements to a garment from the opposite sides thereof, the punch having on its bottom end a projection for snappingly retaining thereon one fastener element while the die having on its top end a recess for receiving therein the other fastener element. Such apparatus is however still disadvantageous in that the fastener elements are susceptible to displacement or detachment from the projection or recess under vibration caused from the apparatus per se. Furthermore the receiving means formed with the punch and die become inoperative when used in such a fastener attaching machine of the horizontal type.

SUMMARY OF THE INVENTION

According to the invention, an apparatus for attaching a pair of fastener elements onto a garment comprising a plunger reciprocably mounted in a bored head for movement along a path toward and away from a stationary die mounted on a table in opposite relation to the bored head. The plunger has a punch for coacting with the die to attach the pair of fastener elements onto the garment from opposite sides thereof. A first means is mounted on the bored head for releasably holding one of the fastener elements in the path in front of the punch. The first means is actuatable by the punch for releasing the one element. A second means is mounted on the die for releasably holding the other fastener element in the path in front of the die. The second means is responsive to coaction with the first means for releasing the other element.

It is an object of the invention to provide an apparatus capable to attach pairs of fastener elements neatly onto a garment from opposite sides thereof.

Another object of the invention is to provide a fastener attaching apparatus comprising means for holding the fastener elements in a proper positional relation with each other before attachment to the garment, even when external forces are applied to the fastener elements from the garment or foreign matter.

The above and the other objects, advantages and features of the present invention will become apparent from the following description of a certain preferred embodiment, taken in conjunction with the accompanying drawings.

DETAILED DESCRIPTION

Figure 1:
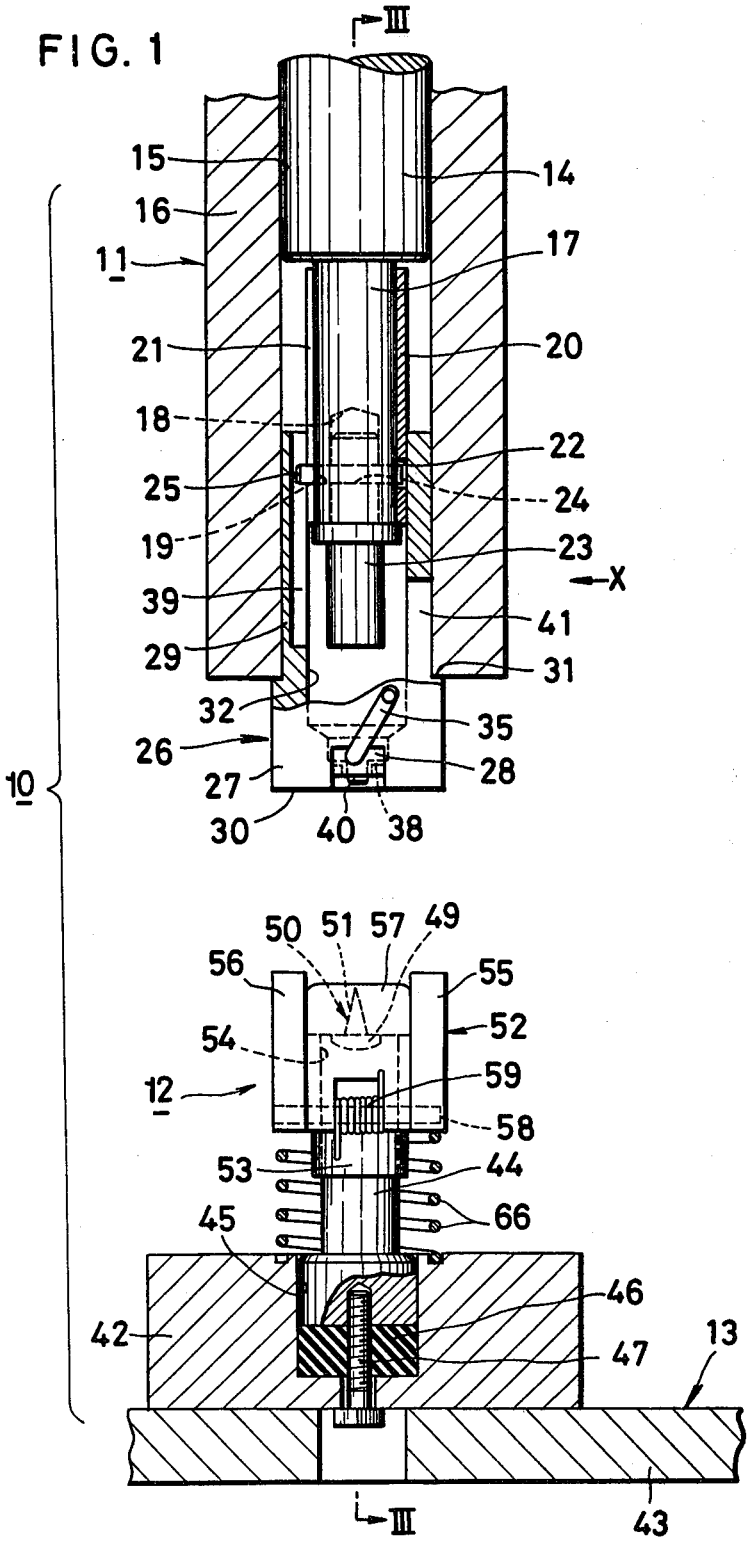
FIG. 1 shows a fragmentary side elevation, partly in section of central parts of an apparatus constructed in accordance with the invention.
Figure 2:
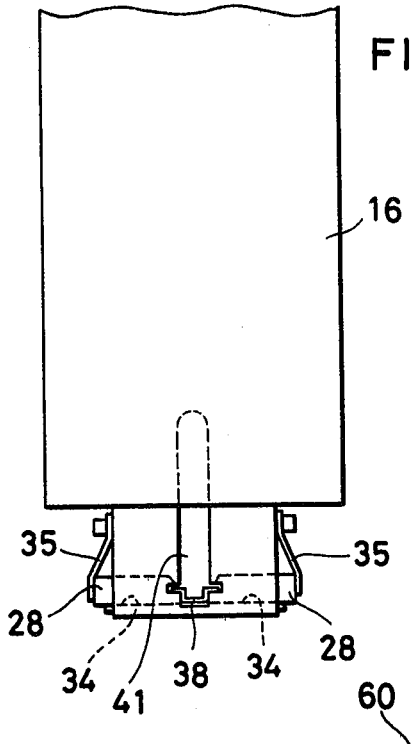
FIG. 2 is a fragmentary elevational view of an upper unit of the apparatus of FIG. 1 looking in the direction of the arrow X.
Figure 3:
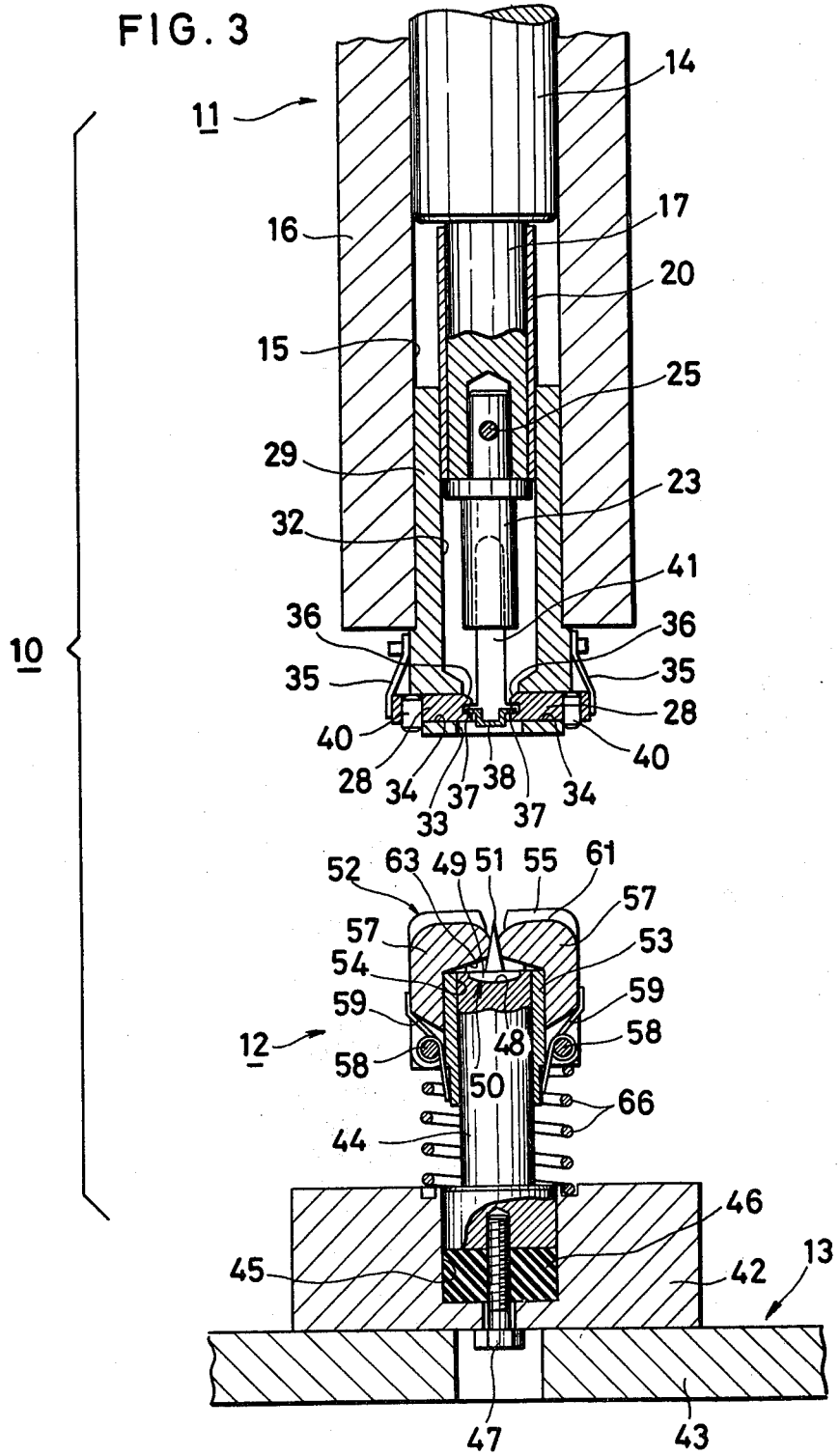
FIG. 3 illustrates a vertical section of the apparatus taken along the line III—III of FIG. 1.

The present invention is particularly useful when embodied in a fastener attaching apparatus such as shown in FIGS. 1, 2 and 3, generally indicated by the reference numeral 10.

The apparatus 10 comprises a cooperative pair of upper and lower units 11 and 12 both mounted on a frame 13 in opposite relation with each other.

The upper unit 11 includes a plunger 14 reciprocable within a bore 15 in a head part 16 integrally formed with the frame 13. The plunger 14 has one or upper end operatively connected to a suitable driving means such as an electric motor or fluid-pressure actuator or the like (not shown) for reciprocating the plunger 14 along a path toward and away from the lower unit 12. The opposite or lower end of the plunger 14 has an integral head 17 extending coaxially with the plunger 14, the diameter of the head 17 being smaller than the diameter of the plunger 14. The plunger head 17 has a blind hole 18 coaxially formed therein and a through hole 19 extending diametrically across the plunger head 17 and blind hole 18. Fitted loosely over the plunger head 17 is a split bush 20 made preferably of a strip of an elastic metal such as spring steel and rounded in conformity with the cross section of the plunger head 17. A slot 21 (FIG. 1) extends longitudinally through the split bush 20 for giving the split bush 20 a resiliency responsive to forces exerted inwardly from the outside of the split bush 20. The split bush 20 has a hole 22 (FIG. 1) formed diametrically opposite to the slot 21 in alignment with the through hole 19 in the plunger head 17.

A clinching punch 23 is fitted in the blind hole 18 in the plunger head 17 with a hole 24 (FIG. 1) formed in its shank being aligned with the through hole 19 in the plunger head 17 and the hole 22 in the split bush 20. The plunger head 17, the split bush 20 and the clinching punch 23 are detachably connected together by a pin 25 fixed in the holes 19,22,24, the pin 25 extending beyond the periphery of the split bush 20 through the slot 21 therein as shown in FIG. 1.

The upper unit 11 further includes a first clamp assembly 26 for releasably holding one fastener element 38 in the path in front of the punch 23. The first clamp assembly 26 comprises a holder 27 reciprocable within the bore 15 in the head part 16 along with the plunger head 17 and a cooperative pair of clamp fingers 28,28 slidably mounted in the holder 27 for movement in the direction perpendicular to the path.

The holder 27 is formed with an elongate hollow cylindrical body 29 slidably fitted in the bore 15 and an integral rectangular head 30 separated by a shoulder 31 from the cylindrical body 29. A bore 32 extending through the cylindrical body 29 into the head 30 has a diameter so dimensioned to compressively fit over the split bush 20, thereby the holder 27 is frictionally held on the split bush 20 under influence of the spring force from the split bush 20 being compressed. A hole 33 formed in the rectangular head 30 extends coaxially with and is contiguous to the bore 32 for guiding therethrough the punch 23. As shown in FIG. 1, the inner wall of the body 29 has a groove 39 extending longitudinally therein for guiding therealong the pin 25 protruding through the slot 21 in the split bush 20. The rectangular head 30 includes a pair of aligned guideways 34,34 formed in a plane perpendicular to the path of the plunger 14 for guidingly receiving therein the pair of clamp fingers 28,28.

Figure 5:
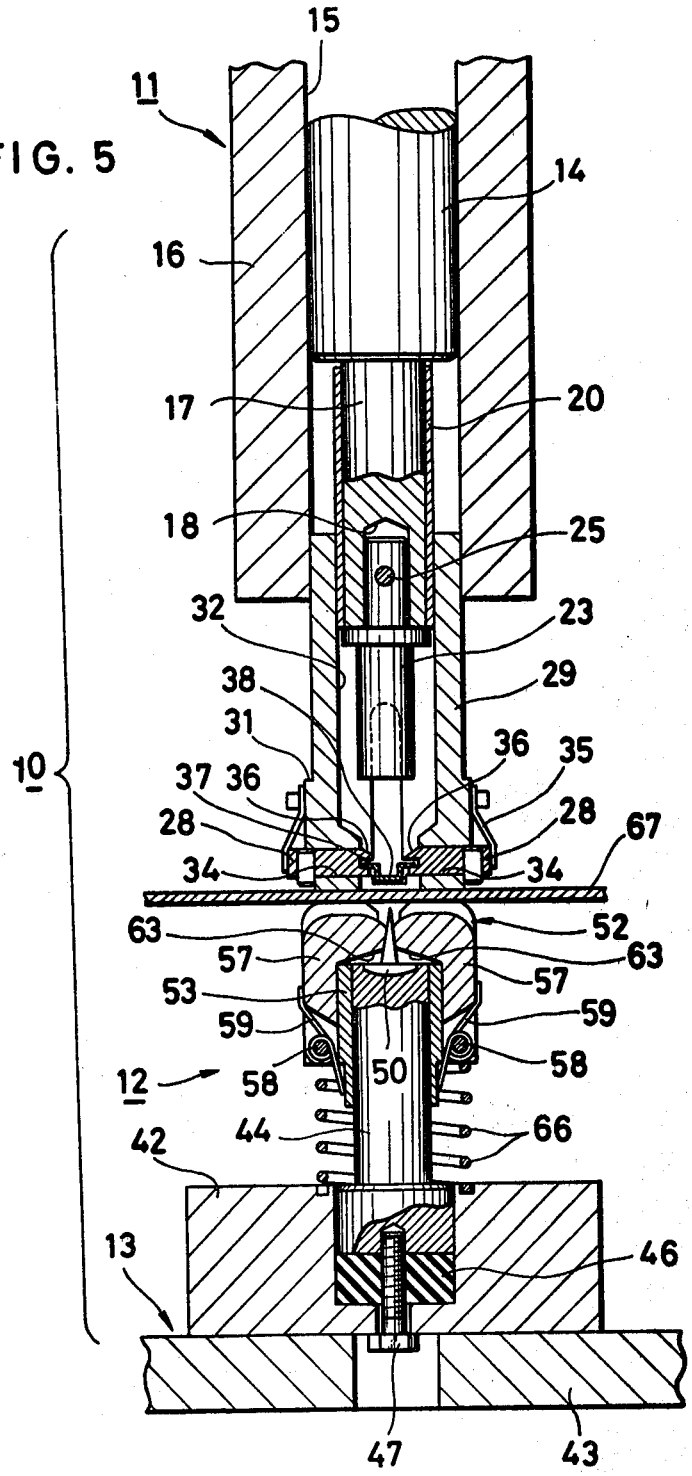
FIGS. 5 and 6 are views similar to FIG. 3, but illustrating the operation of the apparatus.
Figure 6:
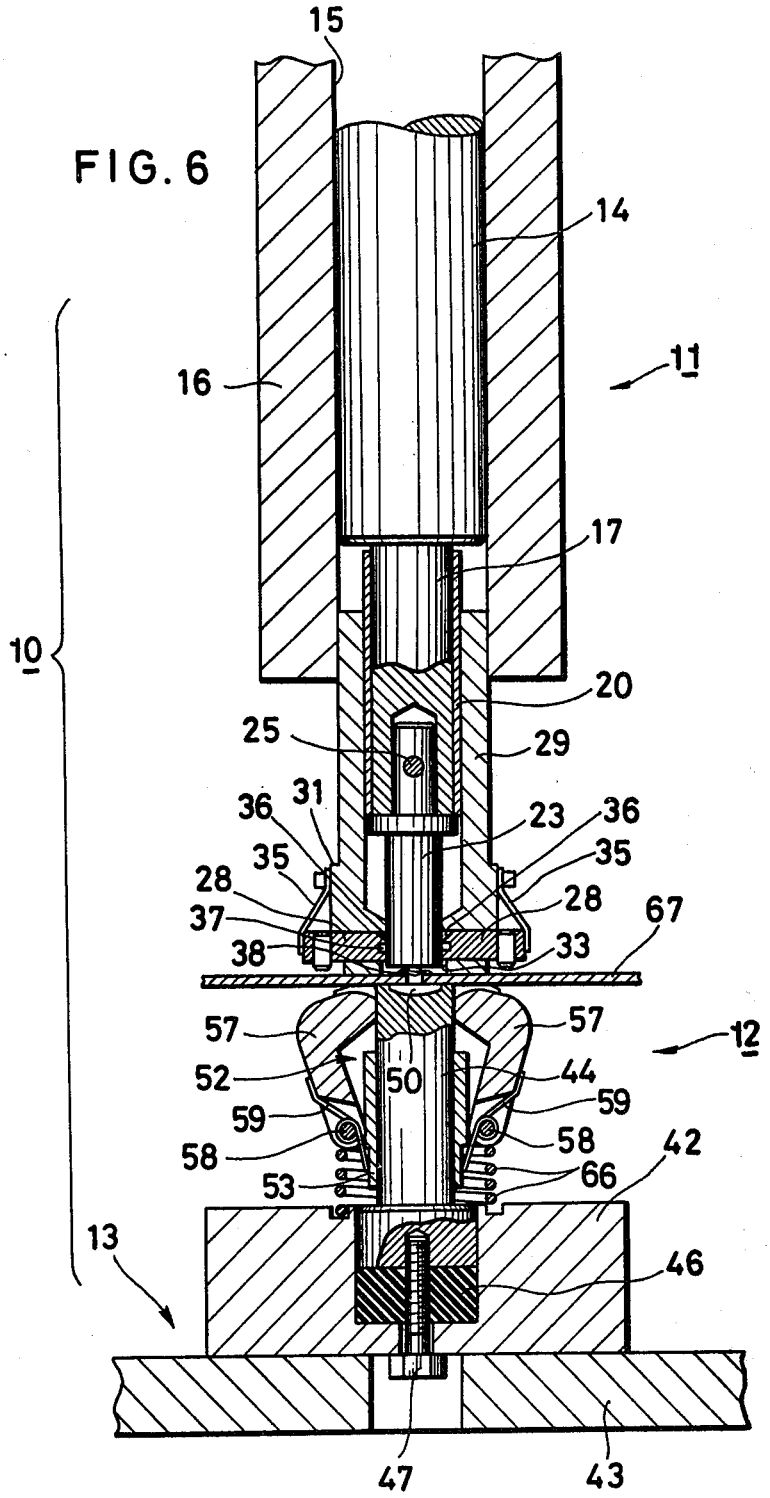

The clamp fingers 28,28 are normally biased toward each other by a pair of leaf springs 35,35 cantilevered on the rectangular head 30. As shown in FIGS. 3, 5 and 6, the clamp fingers 28,28 have at their respective inner ends tapered upper surfaces 36,36 and a pair of horizontally aligned recesses 37,37 releasably receiving therein the one element 38, the fingers 28,28 upon impinging engagement of the clinching punch 23 with the tapered surfaces 36,36, being retracted away from each other for releasing the element 38. It should be understood that the inner ends of the clamp finger 26,28 may have any suitable configurations in accordance with the shape and configuration of the element 38 to be clamped by the clamp fingers 28,28. Projecting laterally from the fingers 28,28 adjacent to their respective outer ends are pins 40,40 acting as stops for preventing the finger 28,28 to be moved toward each other under the spring bias from the leaf spring 35,35. The holder 27 has an elongate opening 41 extending longitudinally upwardly from the rectangular head 30 thereof, the bottom portion of the opening 41 being configurated in complementary to the configuration of the element 38 so as to allow the element 38 to be supplied through such portion to and between the clamp fingers 28,28 from a suitable element supplying means such as a chute-and-pusher assembly (not shown).

The lower unit 12 includes a base 42 fixedly mounted on the table 43 supported on the frame 13 and a stationary clinching die 44 arranged in register with the clinching punch 23, the die 44 being fitted in a bore 45 in the base 42 and fastened via resilient means such as a rubber block 46 to the base 42 by means of a bolt 47. The top surface of the clinching die 44 is recessed at 48 to receive therein a head portion 49 of the other fastener element 50 having at least one spike 51 projecting from the head portion 48.

Figure 4:
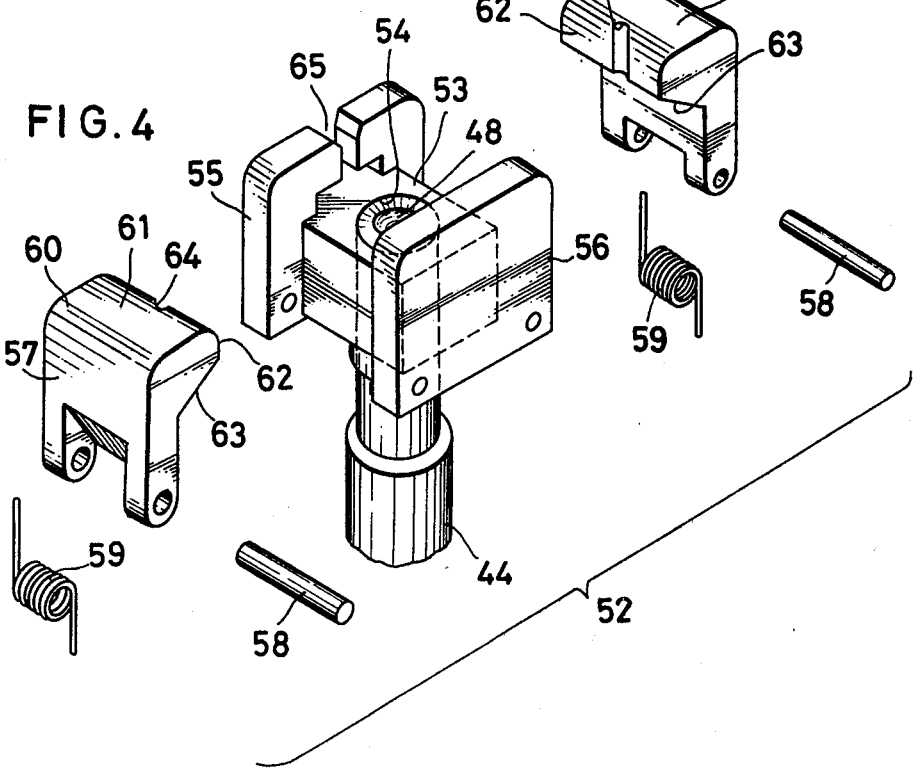
FIG. 4 is an exploded perspective view of a clamp assembly to be associated with a die of the apparatus.

The lower unit 12 further comprises a second clamp assembly 52 for releasably holding the other fastener element 50 in the path in front of the die 44. As best shown in FIG. 4, the second clamp assembly 52 includes a substantially rectangular support block 53 having a bore 54 centrally formed therein and fitted slidably over the clinching die 44, and a pair of spaced end flanges 55,56 formed integrally with the support block 53 at opposite ends thereof. Disposed between the end flanges 55,56 is a cooperative pair of clamp jaws 57,57 each pivotably supported at its bottom or proximal end on the flanges 55,56 by a pin 58 extending across the flanges 55,56. These clamp jaws 57,57 are normally urged against the opposed side surfaces of the support block 53 as by means of torsion springs 59,59 fitted over the respective pins 58,58. The clamp jaws 57,57 are of substantially inverted L-shape as including their respective distal end portions 60,60 projected toward each other over the top surface of the support block 53. The projected end portions 60,60 of the jaws 57,57 include substantially flat top surfaces 61,61 lying somewhat below the top surfaces of the flanges 55,56, opposed inner surfaces 62,62 contiguous to the top surfaces 61,61 and undersides 63,63 slanted divergently from the inner surfaces 62,62, respectively. The opposed inner surfaces 62,62 are grooved or recessed vertically throughout the length as indicated at 64,64 in FIG. 4, in order that the spike 51 of the element 50 may be snugedly received in such grooves 64,64. One of the end flanges 55 has a substantially inverted T-shaped recess 65 formed centrally on the upper portion of the flange 55 such that the element 50 may be delivered from any suitable supplying means (not shown) through the recess 65 to the clinching die 44 and the clamp jaws 57,57. It should be noted the shape and configuration of the recess 48 in the die 44, the grooves 64,64 in the jaws 57,57 and the recess 65 in the flange 55 may be changed in conformity with that of the element 50 to be attached to the garment.

A compression coil spring 66 surrounds the die 44 and is disposed between the base 42 and the support block 53 slidably mounted on the die 44 for normally retain the second clamp assembly 52 in the position shown in FIGS. 1, 3 and 5 in which the top surface of the support block 53 lies flush with that of the die 44.

In operating the apparatus 10 of the present invention, the pair of mating fastener elements 38,50 are delievered from the respective supplying means one at a time through the opening 41 and the recess 65 to the upper and lower units 11,12 respectively and clamped in position by the clamp fingers 28,28 and the clamp jaws 57,57, respectively as shown in FIGS. 1 and 3. A garment 67 is then placed over the top surfaces of the end flanges 55,56 of the support block 53. Upon actuation of the driving means (not shown), the plunger 14 starts to move along the path toward the die 44. The first clamp assembly 26 which is held on the plunger head 17 by the frictional engagement between the split bush 20 and the holder 27 moves along with the plunger 14 until the bottom surface of the holder 27 contacts with the garment 67 shown in FIG. 5. As the plunger 14 further advances toward the die 44, the holder 27 depresses the second clamp assembly 52 against the spring force from the compression spring 66. Responsive to coaction with the support block 53 in the assembly 52, the clinching die 44 is brought into impinging engagement with the slanted surfaces 63,63 of the clamp jaws 57,57, causing the clamp jaws 57,57 to be gradually moved angularly away from each other against the bias from the torsion springs 59,59 for releasing the other element 50. During that period, the second clamp assembly 52 continues to give the first clamp assembly 26 a force responsive to a spring force from the compression spring 66 and the torsion springs 59,59. When the composed spring force is reached to exceed the friction between the split bush 20 and the holder 27, the split bush 20 starts to slide within the bore 32 in the cylindrical body 29 toward the die 44. The clinching punch 23 then impinges upon the tapered surfaces 36,36 of the clamp fingers 28,28 to gradually retract them away from each other against the bias from the lief springs 35,35, thereby the element 38 can be released from the clamp fingers 28,28 and is then pressed onto the garment 67 by the clinching punch 23 extending downwardly through the hole 33 in the rectangular head 30. At the same time, the second clamp assembly 52 is enlowered until the top surface of the flanges 55,56 lies flush with the top surface of the clinching die 44 while the element 50 having been released from the clamp jaws 57,57 is driven with its spike 51 through the garment 67 and the element 38 for clinching engagement with the element 38 between the coacting punch 23 and die 44, as shown in FIG. 6. Upon completion of the attachment, the plunger 14 is actuated to retract along with the first clamp assembly 26 which is held frictionally on the plunger head 17 of the plunger 14. The upward movement of the holder 27 is restricted by the engagement of the shoulder 31 with the bottom end of the head part 16 as shown in FIG. 1.

Although various minor modifications may be suggested by those verst in the art, it should be understood that I wish to embody within the scope of the patent warranted thereon, all such embodiments as reasonably and properly come within the scope of my contribution to the art.

I claim as my invention:

1. An apparatus for attaching a pair of fastener elements onto a garment, comprising:

(a) a frame having a table and a bored head;

(b) a stationary die mounted on said table in opposite relation to said bored head;

(c) a plunger reciprocable mounted in said bored head for movement along a path toward and away from said die having a plunger head supporting a punch for coaction with said die to attach the pair of fastener elements onto the garment from opposite sides thereof;

(d) first means on said bored head for releasably holding one of the fastener elements in said path in front of said punch, said first means being adapted to be actuated by said punch for releasing said one fastener element, and including a substantially hollow cylindrical holder slidably mounted in said bored head in front of said plunger;

(e) second means on said die for releasably holding the other fastener element in said path in front of said die, said second means being responsive to coaction with said holder for releasing the other fastener element; and (f) third means acting between said plunger head and said holder for frictionally retaining said holder on said third means so as to enable said holder to move along with said plunger head, said third means comprising a split bush made of an elastic metal and fitted loosely over said plunger head, said holder being compressively fitted over said split bush so as to be held on said split bush under the resilience of said split bush.

* * * * *